US006148478A

United States Patent [19]

Kuwayama

[11] Patent Number: 6,148,478

[45] Date of Patent: Nov. 21, 2000

[54] COLLISION RESISTANT SUITCASE HOLDER

[75] Inventor: Osamu Kuwayama, Aichi-ken, Japan

[73] Assignee: Sunco Luggage Co., Ltd., Aichi-Ken, Japan

[21] Appl. No.: 09/336,199

[22] Filed: Jun. 18, 1999

[51] Int. Cl.[7] ..... A45C 13/00

[52] U.S. Cl. ..... 16/113.1; 190/115

[58] Field of Search ..... 16/113.1; 190/115

[56] References Cited

U.S. PATENT DOCUMENTS

| | | | |
|---|---|---|---|
| 4,163,484 | 8/1979 | Delaney | 190/115 X |
| 4,754,858 | 7/1988 | Robinson | 190/115 |
| 5,560,083 | 10/1996 | Teixeira | 190/115 X |
| 6,041,900 | 3/2000 | Sadow et al. | 190/115 X |
| 6,062,357 | 5/2000 | Bogert | 190/115 X |
| 6,079,527 | 6/2000 | Kuo | 16/113.1 X |

*Primary Examiner*—Robert J. Sandy
*Attorney, Agent, or Firm*—Harrison & Egbert

[57] ABSTRACT

A suitcase holder resistive of collision having a top seat, which is provided at the top end rod of the suitcase. The exterior of the top seat is formed with a receiving trough and a wall connected with a top plate, so that said receiving trough enables to receive the holder of the rod. At the connection of the wall and the top plate is formed a gap for engaging with a soft cushion, so that to prevent the hand hitting against said top plate of the top seat and the connection edge of the wall while the hand is holding the holder to press down the rod inside to the receiving trough of the top seat.

1 Claim, 6 Drawing Sheets

COLLISION RESISTANT SUITCASE HOLDER

FIELD OF THE INVENTION

The present invention relates generally to a suitcase holder, and more particularly to a suitcase holder resistive to collision.

BACKGROUND OF THE INVENTION

As shown in FIGS. 1 and 2, at the position connection of the conventional suitcase holder between the top seat 10 and the top plate 11 is formed a horizontal edge 12. While the user is holding the holder 13 to press down the rod 14, the hand can easily to collide with the horizontal edge 12 of the top seat 10 due to the force of pressing down. The user's hand can be hurt or clipped by the collision.

SUMMARY OF THE INVENTION

The primary objective of the present invention is therefore to provide a suitcase holder resistive to collision, which is provided with a soft cushion at the horizontal edge of the top seat. This will prevent the hand from hitting against the top plate and to avoid the hand from being clipped.

The objective, features and functions of the present invention will be readily understood upon a thoughtful deliberation of the following detailed description of the present invention with reference to the accompanying drawings.

DETAILED DESCRIPTION OF THE INVENTION

Figure 1:
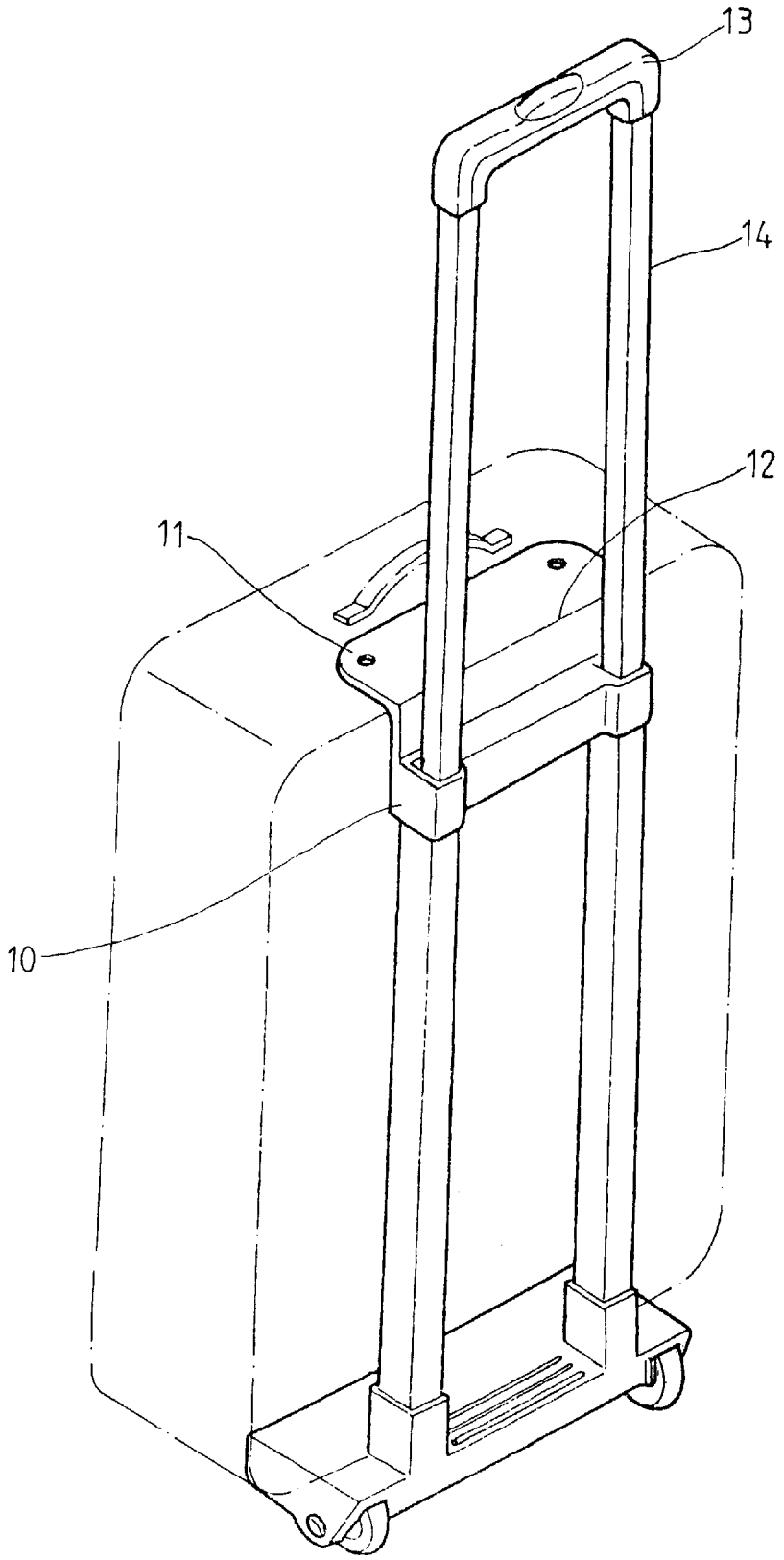
FIG.1 PRIOR ART
FIG. 1 shows a perspective view of the prior art suitcase holder in combination.
Figure 2:
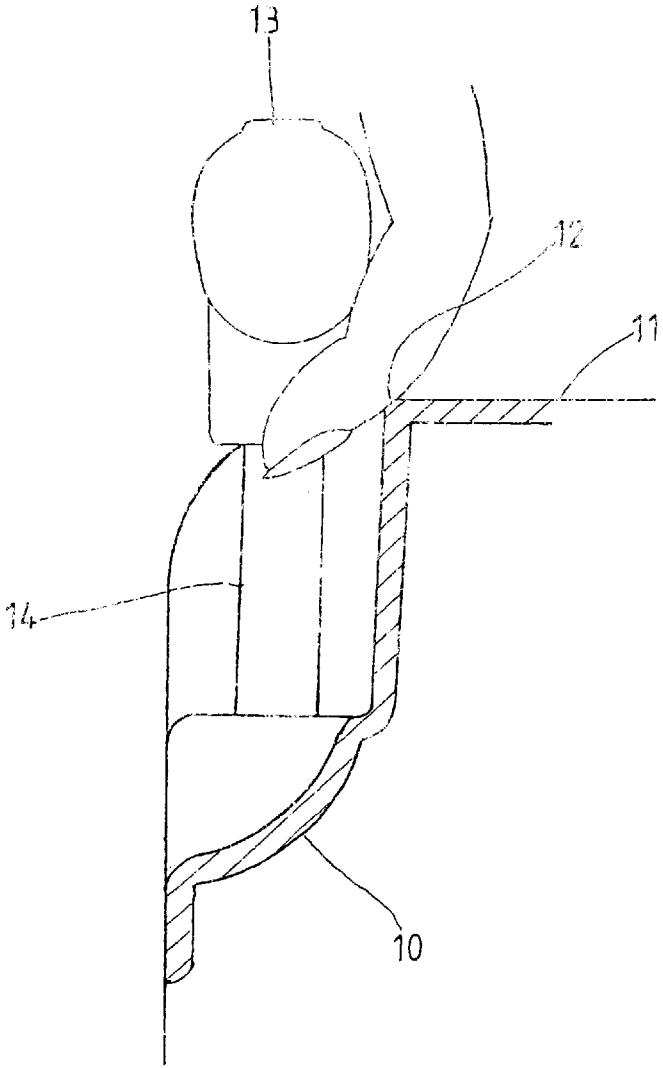
FIG.2 PRIOR ART
FIG. 2 shows a schematic view of the prior art suitcase holder in operation.
Figure 3:
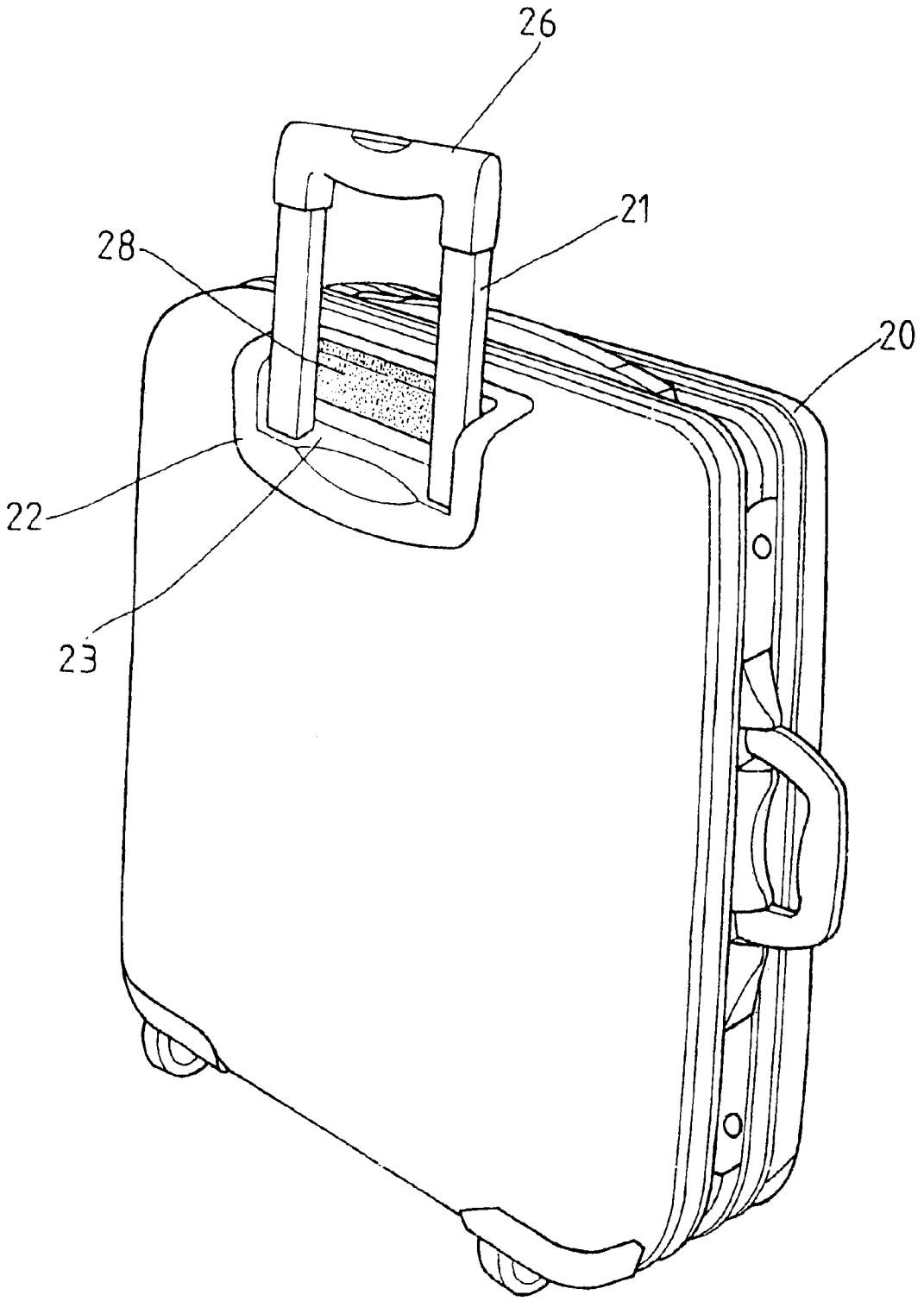
FIG. 3 shows a perspective view of the present invention in combination.
Figure 4:
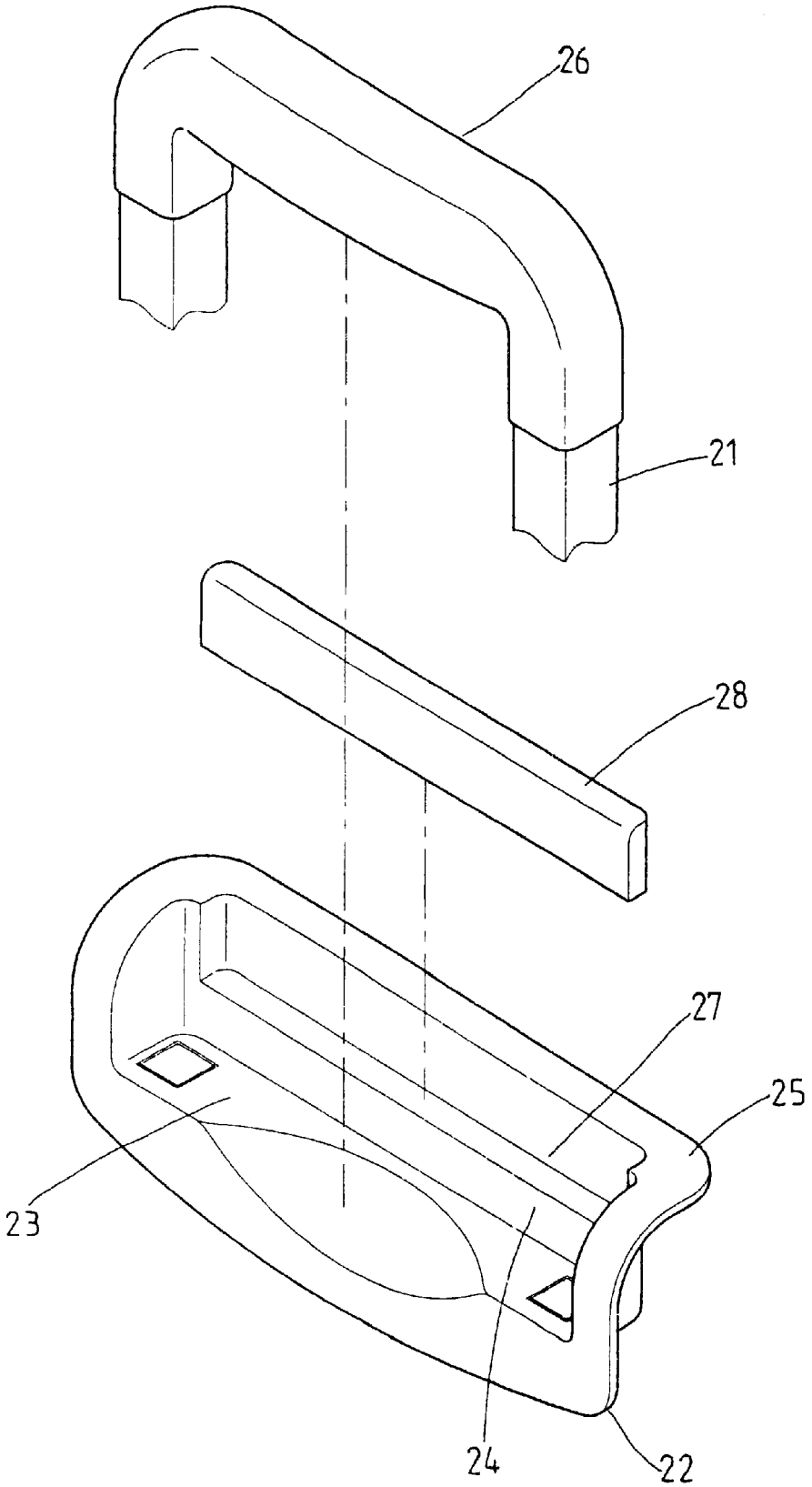
FIG. 4 shows an exploded view of the present invention.

As shown in FIGS. 3 and 4, the top end rod 21 of the suitcase 20 is provided with a top seat 22, on the exterior of which is formed a receiving trough 23 and a wall 24 connected with a top plate 25, so that the receiving trough 23 receives the holder, or handle, 26 of the rod 21.

The feature in the present invention is that the connection of the wall 24 and the top plate 25 are formed with a gap 27 for engaging with a soft cushion 28, so as to prevent the hand from hitting against the top plate 25 of the top seat 22 and the connection edge of the wall 24 while the hand is holding the holder 26 to press down the rod 21 inside to the receiving trough 23 of the top seat 22.

Figure 5:
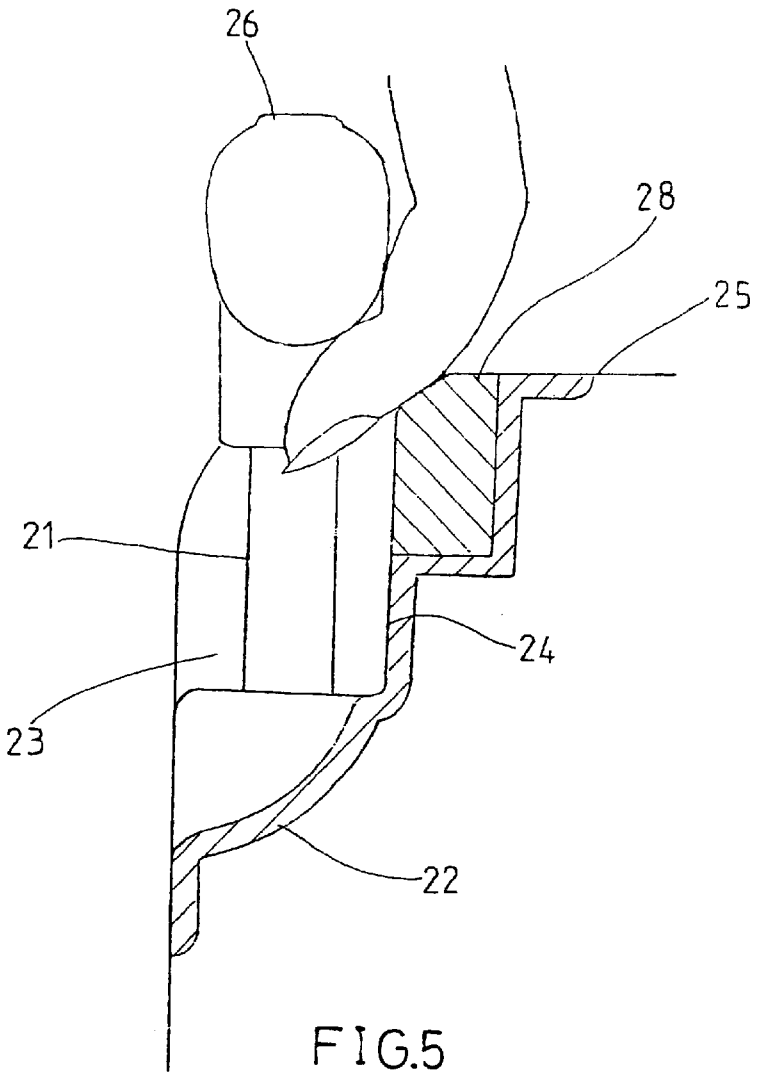
FIG. 5 shows a schematic view of the present invention in operation.
Figure 6:
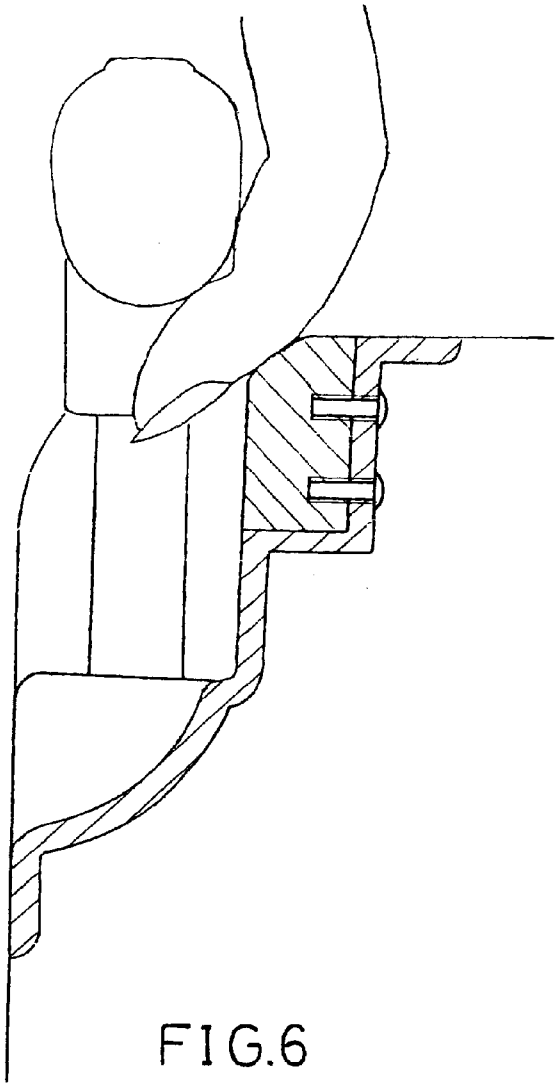
FIG. 6 shows another schematic plain view of the present invention in operation.

As shown in FIG. 5, when the user holds the holder 26 to press down the rod 21 inside the receiving trough 23 of the top seat 22, the hand contacts in advance the soft cushion 28. With the protection of the soft cushion 28 can avoid the hand from being hurt by the force of pressing down which collides with the top seat 22, and further prevents the hand from being clipped. This enables the release of the holder 26, or to re-press the holder 26 again inside to the receiving trough 23 of the top seat 22 for gathering.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claims.

What is claimed is:

1. A collision resistant suitcase holder comprising:

a handle having a top end of a rod connected therewith;

a top seat having a receiving tough, a top plate, and a wall connected with the top plate, the receiving tough receiving the top end of the rod;

a gap formed at a connection edge of the wall and the top plate; and a cushion engaged with the gap so as to prevent a hand of a user from hitting against the connection edge of the wall and top plate of the top seat while the hand of the user is holding the handle to press down the rod inside to the receiving tough of the top seat.

* * * * *